United States Patent [19]

Takada et al.

[11] 4,024,721

[45] May 24, 1977

[54] METHOD AND APPARATUS FOR LAYING PIPES IN THE GROUND

[75] Inventors: Hiroshi Takada; Kenzo Hoashi, both of Yokohama, Japan

[73] Assignee: Kabushiki Kaisha Komatsu Seisakusho, Tokyo, Japan

[22] Filed: Dec. 22, 1975

[21] Appl. No.: 643,119

[30] Foreign Application Priority Data

May 23, 1974 Japan ..... 49-057323

[52] U.S. Cl. ..... 61/72.7; 175/62; 254/29 R

[51] Int. Cl.[2] ..... F16L 1/00

[58] Field of Search ..... 61/72.7, 72.1, 72.5, 61/42; 254/29 R; 175/62; 173/152

[56] References Cited

UNITED STATES PATENTS

| | | | |
|---|---|---|---|
| 2,656,683 | 10/1953 | Riva | 61/72.7 |
| 3,415,329 | 12/1968 | Marlind | 175/62 X |
| 3,742,581 | 7/1973 | Roodveis | 61/72.7 X |
| 3,881,558 | 5/1974 | Dolza | 61/72.7 X |
| 3,894,402 | 7/1975 | Cherrington | 175/62 |

*Primary Examiner*—Jacob Shapiro
*Attorney, Agent, or Firm*—Armstrong, Nikaido & Marmelstein

[57] ABSTRACT

There is disclosed a method and apparatus for laying small-diameter gas, water pipes or the like precisely in the ground. Small-diameter pilot pipes are first laid in while at the same time, a pilot head is measured and controlled to make its straight advance. Pipes of a larger diameter are then laid in successively, the pipes being led by the pilot pipes. Concurrent with this, excavated earth is discharged through the laid-in pilot pipes.

11 Claims, 14 Drawing Figures

METHOD AND APPARATUS FOR LAYING PIPES IN THE GROUND

BACKGROUND OF THE INVENTION

This invention relates to a method and apparatus for laying pipes in the ground and, more particularly, to the laying-in of pipes such as drainage, gas, water pipes, or cables of a relatively small diameter One of the more common ways of laying pipes into the ground is that trenches are dug, the pipes are then placed in the trench, and finally the trench is filled with earth. When a relatively large land space is available, no difficulty with this method of laying-in of the pipes exists. However, various problems arise when digging trenches in roads is carried out in big cities where sufficient land spaces are not available. More specifically, for instance, pavement must be destroyed and the traffic is considerably obstructed in the course of construction.

Various attempts have heretofore been made to eliminate these problems by laying the pipes in the ground without digging the trenches. One such attempt has been to lay in the pipes and discharge excavated earth from the rear end of the laid-in pipes and another attempt has been to press the pipes into the ground upon consolidation of soil. A major difficulty with the first-mentioned attempt is that the scraped soil is removed from the rear end of the pipes by means for example of screw conveyors disposed within the pipes and, hence, the pipes are filled up with the scraped soil which is being discharged, with the results that the foremost point where the excavation is carried out can not be detected from a departure pit from the which the pipes are laid in, and thus the straight advance of the laid-in pipes is difficult to be maintained. Furthermore, since the scraped soil discharged into the departure pit, installation of a jack for pressing the pipes to be laid in, and control equipment and the like within the departure pit is limited, and earth hauling operation is interfered with thereby resulting in poor working efficiency. Later attempts to provide a detector pipe extending along the peripheral surface of and in parallel with the axis of the laid-in pipes so as to detect a vertical position of the front end of the laid-in pipes from the departure pit have met with only partial success, since these attempts have involved undesirable additional procedures to remove the detector pipe and to fill the space formed thereby with cement or the like, after the laying-in of the pipes is completed. Other difficulties occurring with the first-mentioned attempt are as follows: it is difficult to control the direction of advance of the laid-in pipes since the posture of the foremost, excavating point is unable to be detected and, hence, the operator must be skilled in ensuring that the pipes are advanced as straight as possible; the screw conveyor rotated in the laid-in pipes tends to damage the inner surface of the pipes; for this reason, the pipes to be laid in are in most cases limited to steel pipes as pipes of reinforced concrete are not suitable for this method; where it is absolutely necessary to use the pipes of reinforced concrete, steel pipes should be placed in the reinforced concrete pipes in order to prevent the inner surface of the latter from being damaged by the rotating screw conveyor; and there must be inserted the screw conveyor that fits with the internal diameter of the pipes, and this increases the cost of equipment because constructors must have a wide variation in types and forms of screw conveyors to accommodate many different sizes of pipes to be laid in.

A difficulty attendant with the other attempt to press the pipes into the ground upon consolidation of soil is that since the degree of consolidation of soil is increased as the laid-in pipes increase in diameter, considerably large apparatus become necessary in order to obtain a jack pressure large enough to press pipes of corresponding sizes into the ground. Furthermore, this attempt has various other shortcomings. Pressing the pipes into the ground raises the surface of the ground, resulting in damage to road surfaces or other adjacent laid-in pipes. This defect causes undesirable limitations in the course of construction since the depth of laying-in of the pipes is increased, and such a method finds use only where soil is relatively soft. Furthermore, the plan of burying pipes should be made with maximum care in an attempt to laying the pipes at a position remote from those pipes which have already been laid in.

According to another method disclosed in Japanese Patent Publication No. 49-19767, small-diameter pilot pipes are first pressed into the ground by a hydraulic jack, and large-diameter pipes are led by the pilot pipes and then laid in the ground. While this method is highly efficient, straight advancement of the laid-in pipes is not expected on account of the lack of control of the front end of the pilot head. The pilot pipes are followed by the large-diameter pipes which are laid-in upon consolidation of soil without excavating earth, and thus a relatively large consolidation pressure becomes necessary. This requires a considerably large-sized apparatus. In short, this latter method shares the common deficiencies with the foregoing prior art attempt which makes use of consolidation of soil.

SUMMARY OF THE INVENTION

An object of this invention is therefore to provide a method and apparatus for laying pipes in the ground, which eliminate the above-noted difficulties.

Another object of the invention is to provide a method and apparatus for laying pipes precisely in a desired position in the ground.

Still another object of the invention is to provide a method and apparatus as set forth above, specifically for preventing the ground surface from being raised in the course of the laying-in of the pipes and for minimizing adverse influence on adjacent laid-in facilities, the adverse influence being due to increase in compressibility of soil around the laid-in pipes.

Yet another object of the invention is to provide a pipe laying-in method which can be carried out without skillful operation.

In accordance with the invention, there is provided a departure pit and an arrival pit which is dug in spaced-apart relation to the departure pit. A propulsion jack is provided in the departure pit, and is adapted to propel pipes to be laid in. While a pilot head and following pilot pipes are laid in the ground by the propulsion jack, the position and posture of the pilot head are measured from within the departure pit. The pipes are laid in with straight advance of the pilot head being controlled based on the measured values.

Other objects, features and advantages of the present invention will be readily apparent from the following description taken in conjunction with the accompanying drawings.

BRIEF DESCRIPTION OF THE DRAWINGS

FIGS. 6–1 through 6–4 are enlarged views illustrating successive steps of operation relative to the direction correction of the pilot head;

DETAILED DESCRIPTION OF THE PREFERRED EMBODIMENT

Figure 1:
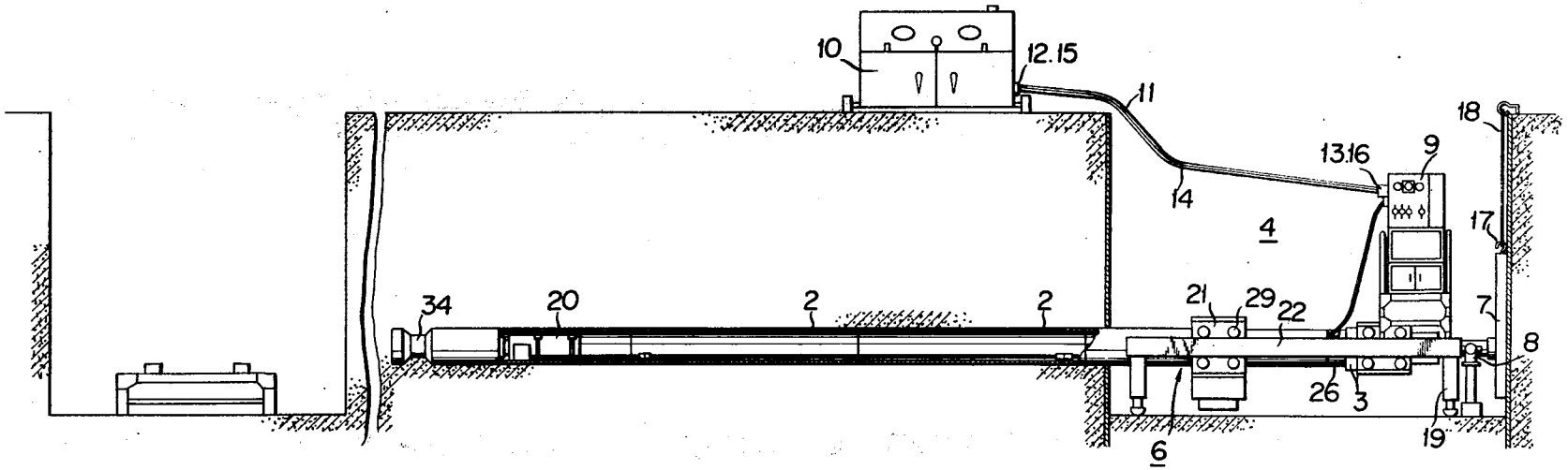
FIG. 1 is a schematic elevational view explanatory of the way in which pilot pipes are laid into the ground in accordance with a method of the invention.

In FIG. 1, there are shown a pilot head 1 and pilot pipes 2 connected in following relation to the pilot head 1, the pilot head 1 and the pilot pipes 2 being pressed into the ground by a propulsion jack 3. The pilot pipes 2 are propelled from a departure pit 4 until a foremost pipe 2 reaches an arrival pit 5.

The departure pit 4 has therein a propulsion device 6, a reaction plate 7, a transit 8 and a control unit 9. The control unit 9 is operated by the operator to control the overall operation.

On the ground surface above the departure pit 4, there is provided a power source 10 from which an oil pressure is supplied through a hydraulic rubber hose 11 to the control unit 9. The hydraulic rubber hose 11 has at the both ends a pair of connectors 12, 13 to facilitate connection with the power source 10 and the control unit 9. Electric power is supplied through the power source 10 and an electric cable 14 to the control unit 9. The electric cable 14 has at the both ends a pair of connectors 15, 16 to facilitate connection with the power source 10 and the control unit 9.

Where the length of one hydraulic rubber hose 11 or one electric cable 14 comes short of the depth of the departure pit 4, additional hoses or cables of the same size can be used so as to increase the overall length of the combined hoses or cables.

The reaction plate 7 has at its top a hanging hook 17 to which there is connected a wire 18 extending from the top of a sheathing board, thereby hanging the reaction plate 7.

Four legs 19 are provided beneath the propulsion device 6 the legs 19 being vertically extensible by hydraulic pressure so that the propulsion device 6 can be maintained at a given height and grade. The hydraulic pressure is of course supplied from the control unit 9.

A transit 8 (this may be a laser transit or a laser beam emitter) is provided on the bottom of the departure pit 4 and is positioned slightly forwardly of the reaction plate 7, the transit 8 being so arranged at a given position and grade as to be able to measure a target 20 located at the rear end of the pilot head 1. A pipe support 21 has pipe supporting rollers the height of which is adjustable by a jack in order to maintain a pipe at a given elevation when the pipe is placed on the supporting rollers.

Figure 2:
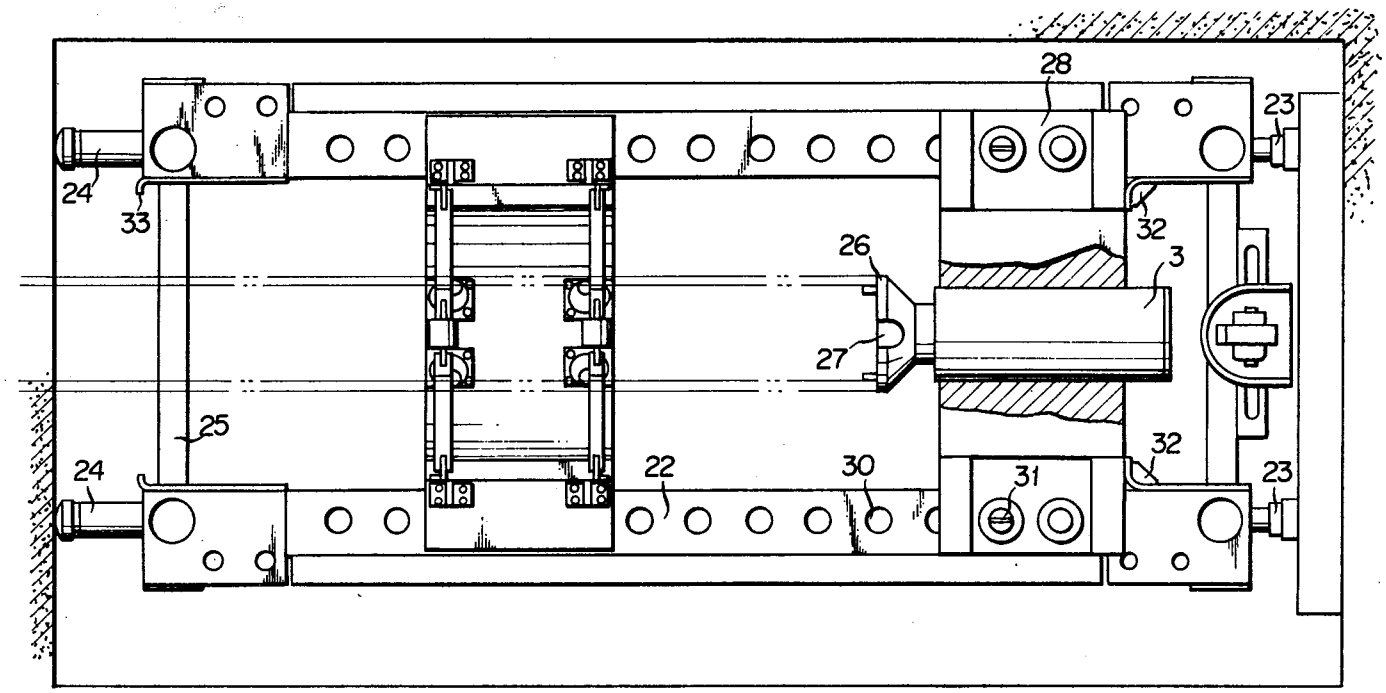
FIG. 2 is a plan view of a pipe propulsion device.
Figure 3:
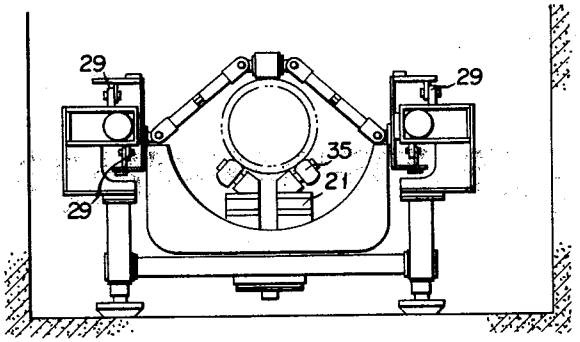
FIG. 3 is a left-hand side elevational view of FIG. 2.

As shown in FIGS. 2 and 3, the propulsion device 6 comprises a pair of rails 22, the rail legs 19, the propulsion jack 3, the pipe support 21, a pair of equalizing jacks 23 located rearwardly of the rails 22, and a pair of screw jacks 24 located forwardly of the rails 22. The rail legs 19 extend downwardly in a direction normal to a plane in which the two parallel rails 22 lie, the legs 19 being connected by a pair of channels 25 to form the rails 22 integrally with each other. The rails 22 installed in the departure pit 4 extend in parallel with the direction of advance of the propelled pipes. As described before, the height and grade of the rails 22 is established by changing the length of the four adjustable rail legs 19. A propulsion adapter 26 is attached to the front end of the propulsion jack 3, the adapter 26 having parts suitable in shape for fitting with the pilot pipes 2. The propulsion adapter 26 has a cutaway recess 27 through which there are passed the hydraulic rubber hose 11 and the electric cable 14 that lead from the pilot head 1. The front end of the adapter 26 has its outside diameter smaller than the inside diameter of the rear end of the pilot head and of the pilot pipes such that the adapter is prevented from slipping away from the pilot and the pilot pipes. The adapted 26 has a pair of bosses 36 (FIG. 4) which are bolted to a pair of bosses 37 (FIG. 4) of the pilot head or the pilot pipes. The propulsion jack 3 is placed on the two rails with propulsion jack brackets 28 interposed therebetween. The propulsion jack 3 mounted on the propulsion jack bracket 28 is movable on the rails forwardly and rearwardly in the direction of advance of the pipes by means of rollers 29 mounted on the brackets 28, but is not movable vertically and laterally. The propulsion jack 3 is secured to the rails 22 by inserting pins 31 into registered pin-receiving holes 30 which are formed in the rails 22 and the propulsion jack brackets 28. The distance of any adjacent holes 30 in the rails is made smaller than the full stroke of the propulsion jack. When the propulsion jack secured at a given position to the rails is extended the full stroke, then the pins 31 are removed and the propulsion jack is contracted the full stroke. Thereafter, the propulsion jack 3 is shifted forwardly on the rails and the pins 31 are inserted again, when the propulsion jack is ready for the next propulsion. This operation is repeated so as to move the propulsion jack brackets 28 forwardly in an intermittent step-like manner. Upon the completion of propulsion of the entire length of the pipe 2 to be laid in, the propulsion jack is manually returned to rear stoppers 32, whereupon a next pipe may be set and likewise propelled. The rails are pressed against the reaction plate 7 through the equalizing jacks 23. The reaction force that the propulsion jack 3 creates during the pipe propulsion acts through the propulsion jack brackets 28, the pins 31, the rails 22 and the equalizing jacks 23 at the rear ends of the rails against the reaction plate 7. The propulsion jack 3 and the propulsion jack adapter 26 have axial bores through which the interior of the laid-in pipes can be viewed from the rear end of the propulsion device. Thus, as shown in FIG. 1, the target 20 in the pilot head 1 can be measured by the transit 8 set previously in a datum position and direction for the pipe laying-in at a position adjacent the reaction plate 7 in order to determine the position and tilt of the pilot head for the direction control of the latter.

The pipe support 21 is vertically movable by a hydraulic jack to raise or lower a pair of pipe-supporting rollers 35. Pipes of different sizes can be laid in by placing them on the rollers 35 and aligning the axes of the pipes with that of the propulsion jack. Since the pipe support 21 is shiftable on and along the rails with a pipe being supported thereon, the pipe support 21 may be moved to an any selected position whereupon a pipe to be laid in can be set thereon and can be propelled by the propulsion jack. With the pipe support 21 supporting the pipe via the rollers 35, after the pipe support 21 is moved to the stoppers 32 on the rails, the pipe can only be moved forwardly without the movement of the pipe support 21. Accordingly, the setting operation of the pipes can be made with ease and the pipes can be supported on the propulsion device 6 until the completion of laying of the pipes into the ground.

The rails 22 of the propulsion device are immovably supported by the screw jacks 24 held against the front wall of the departure pit and by the equalizing jacks 23 held against the rear wall of the departure pit through the reaction plate 7. A jack-extending side of the cylinder of the equalizing jacks 23 is arranged to be supplied with the same hydraulic pressure as the propulsion jack 3. Each of the two equalizing jacks 23 has the jack-extending cylinder side with an area against which the pressure acts being slightly larger than half of a pressure-acting area in a jack-extending cylinder side of the propulsion jack 3. Assuming that a propulsion force acting on the propulsion jack 3 is F, F acts through the rails on the two equalizing jacks 23, and with the arrangement described above, the equalizing jacks 23 are subject to a force of $F + \alpha$ (the force $\alpha$ is small in comparison with F). Thus, the propulsion rails 22 are pressed against the rear wall of the departure pit by the two equalizing jacks 23 developing the force $\alpha$, so that the propulsion device 6 can be held stationary.

Normally, the rear wall of the departure pit is formed by placing sheet piles or concrete in order to withstand the reaction force from the propulsion jack 3. Practically, the propulsion rails are very difficult to be maintained stationary and thus tend to become displaced when the propulsion force is exerted. According to the invention, the displaced amount is absorbed by the extensible and contractable equalizing jacks 23 thereby maintaining the propulsion rails 22 in a fixed position.

The front ends of the propulsion rails are adapted to be pressed against the front surface of the departure pit through the screw jacks 24 attached to the front ends of the propulsion rails, the screw jacks 24 being arranged to withstand a retracting force which is created during the retraction and re-propulsion of the pilot head, as hereafter described.

The equalizing jacks 23 and the screw jacks 24 can be removed and attached with ease, and the jacks can be replaced with each other in position. More specifically, the pipe arrangement for the equalizing jacks 23 is removed and then the stoppers 32 which serve as covers for the propulsion rails are removed to take out the equalizing jacks 23. Likewise, covers 33 on the front end of the propulsion rails are detached to take out the screw jacks 24. The equalizing jacks 23 and the screw jacks 24 are replaced with each other in position and the covers are attached as before. When it is necessary to change the direction of propulsion of the propulsion jack 3, the latter is reversed in its longitudinal direction by detaching and attaching the propulsion jack brackets 28. More specifically, the propulsion jack 3 and the propulsion jack brackets 28 are separated from each other by removing bolts which connect these members together. After the propulsion jack 3 is removed, the pins 31 are detached and then the two opposed propulsion jack brackets 28 placed on the propulsion rails 22 is forced to slide along the inside of the rails and finally out of the rails. The pipe support 21 is moved on the propulsion rails 22 and the removed propulsion jack brackets 28 are reversed in the direction of propulsion, whereupon the brackets are secured to the rails 22 by the attachment pins 31. Then, the removed propulsion jack is reversed in its longitudinal direction and is inserted between the propulsion jack brackets 28. The propulsion jack 3 and the propulsion jack brackets 28 are securely bolted to each other. Locations at which the reaction plate 7 and the transit 8 are installed are changed, then the screw jacks 24 are attached and the equalizing jacks 23 are piped. In this way, the direction of propulsion can be reversed without moving the propulsion rails which have been installed in alignment with the direction of laying-in of the pipes. Thus, the direction of propulsion can be changed only by lifting the lightweight parts without employing a large-sized crane which would otherwise be required to lift the propulsion rails 22. With this arrangement, working efficiency can be enhanced manifold.

The steps of laying in the pilot pipes by propelling the pilot head will now be described. The pilot head 1 is first placed on the pipe support 21. Upon movement of an operation lever (not shown) connected to a hydraulically-operated valve in the control unit 9, a pilot jack 34 provided on the front portion of the pilot head is advanced and pressed into the ground by the distance of the full stroke of the jack. The operating lever is returned to its neutral position and another lever is operated, whereupon the rod of the propulsion jack 3 is advanced to press the pilot head into the ground. At this time, the pilot jack, 34 are contracted by the pressing force of the pilot head 1. The reaction force during this operation acts against the reaction plate 7 through the pins 31, the rails 22, and the equalizing jacks 23 located at the rear ends of the rails.

When the rod of the propulsion jack 3 is extended to the end of its stroke, the pins 31 is pulled up whereupon the lever is moved in the reverse direction in order to withdraw the rod. Since the rod of the propulsion jack 3 is bolted to the pilot head 1 via the adapted 26, the propulsion jack proper is advanced upon the advance of the pilot head. Then the pins 31 are inserted into and engaged with the pin-receiving holes in the propulsion jack bracket 28 and the holes in the rails, which holes are located forwardly of those which have previously received the pins. As before, the pilot jack 34 is advanced and the propulsion jack 3 is then advanced. The pilot head is pressed into the ground by what might be called "multi-step propulsion."

When the pilot head is laid completely in the ground, the pins 31 engaging the propulsion jack bracket 28 with the rails 22 are pulled up, and then the propulsion jack 3 is manually or power-drivingly returned into abutment against the rear stoppers 32. The pipe support 21 is manually returned to a position substantially centrally between the rear end of the pilot head and the propulsion jack adapter 26.

The pilot pipe 2 to be laid in is placed on the pipe-supporting rollers 35, whereupon a collar 38 (FIG. 5) is attached to the front end of the pilot pipe 2. The connectors 13, 16 of the hydraulic rubber hose 11 and the electric cable 14, respectively, are detached from the control unit 9, and then are passed through the pilot pipe 2 from the front end of the latter for connection with the control unit 9. The pilot pipe 2 is shifted on the pipe-supporting rollers 35 to insert the collar 38 into the rear end of the pilot head 1. The bosses 37 on the rear end of the pilot head and the bosses 37 on the front end of the pilot pipe are connected together by bolts 40 and nuts 41 with rubber washers 39 interposed therebetween.

By inserting the rubber washers 39, the pilot head and the pilot pipe are prevented from being rigidly interconnected, and this head-to-pipe connection can be bent vertically and horizontally as the rubber washer 39 is compressed. This connection is hereafter referred to as a "loose-coupling."

Finally, the propulsion jack is manually moved until the adapter 26 coupled to the propulsion jack 3 abuts against the rear end of the pilot pipe 2, and then the pins 31 are inserted into the pin-receiving holes 30 so as to secure the propulsion jack to the rails.

In this way, the preparation of a next propulsion is completed. The pilot pipes 2 are then pressed into the ground through the multi-step propulsion using the propulsion jack 3 and the pilot jack 34.

When the front end of a first pilot pipe 2 has reached the arrival pit 5, the bolts and nuts connecting the bosses 37 together as well as the hydraulic rubber hose 11 and the electric cable connected to the rear end of the pilot head by connectors are removed. The pilot head is disconnected from the pilot pipe and is collected. Then, the hydraulic rubber hose 11 and the electric cable 14 are withdrawn at the departure pit, when the laying-in of the pilot pipes are completed.

A process of correcting the deflected direction of propulsion of the pilot head will now be described, which deflected direction of propulsion may be caused by unbalanced soil or stones during the laying-in of the pipes.

Figure 4:
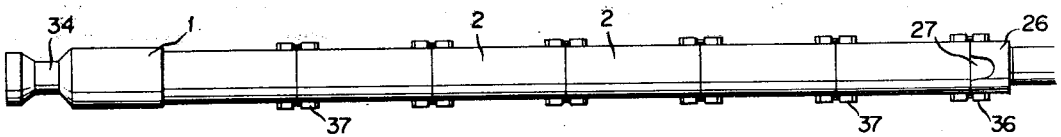
FIG. 4 is a schematic view explanatory of the way in which a pilot head and the pilot pipes are interconnected with each other.
Figures 1, 6:
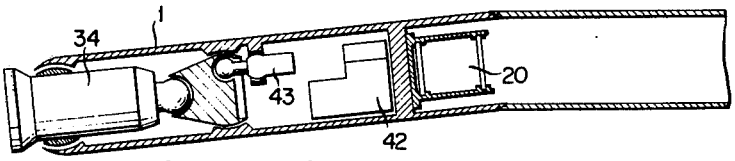
Figures 2, 6:
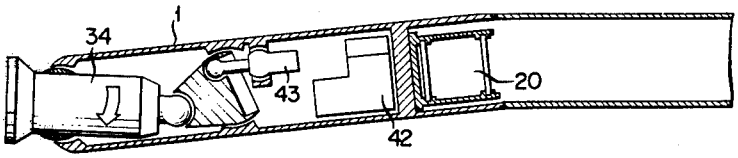
Figures 3, 6:
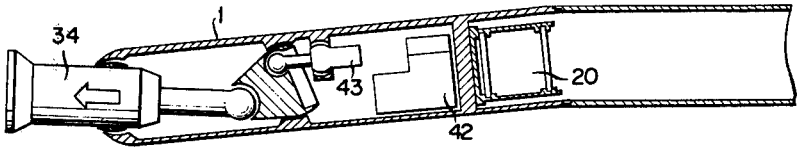
Figures 4, 6:
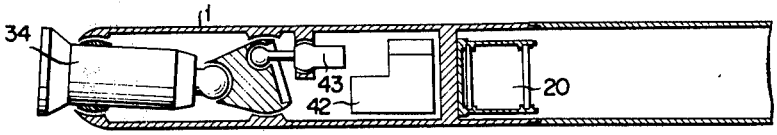

FIGS. 6-1 through 6-4 schematically shows successive steps in which the pilot head is operated to change its direction of advance.

FIG. 6-1 shows the pilot head deflected downwardly in its direction of propulsion under the influence of unbalanced soil, stones or the like. The deflection in the direction of propulsion can be read out at the control unit 9 by observing the target 20 in the pilot head or a clinometer 42. FIG. 6-2 shows the pilot jack 34 being swung by operating a cylinder 43.

FIG. 6-3 shows the pilot jack 34 being hydraulically advanced.

When the pilot jack 34 is advanced, the pressure acting on jack-extending side of the pilot jack cylinder is released. The pilot head and the pilot pipes are then advanced by the propulsion jack 3 in the departure pit 4, so that the pilot head proper is propelled forwardly as the pilot jack 34 is contracted on account of the soil abutting against the front surface of the pilot head. By repeating this operation, the pilot head proper is subject to a force tending to follow the pilot jack 34 and finally is returned to the correct position. In FIG. 6-4, the pilot head is maintained in its correct position. In this position, after the pilot jack 34 is horizontally advanced, the advance of the pilot head and the pilot pipes are repeated so that the pilot head can make its straight advance in a relatively stable manner. In accordance with this invention, the advance of the pilot head is less influenced by the unbalanced soil than the case where the pilot head is pressed into the ground by the propulsion jack without using the pilot jack.

There will now be discussed a process of correcting a high degree of deflection in the direction of propulsion of the pilot head, which deflection is unable to be recovered by the foregoing correction process.

Figure 5:
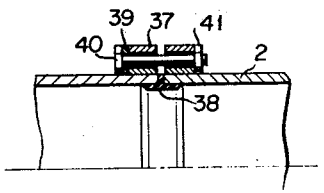
FIG. 5 is a fragmentary enlarged view showing the manner in which the pipes are interconnected.

The pilot head 1, the pilot pipes 2 and the propulsion jack 3 in the departure pit are interconnected by the bolts as shown in FIG. 4, so that the pilot head and the pilot pipes can be propelled or withdrawn by the propulsion jack 3 in the departure pit. The force created when the propulsion jack 3 in the departure pit withdraws the pilot head and the pilot pipes acts against the front wall of the departure wall through the propulsion rails 22. With this arrangement, when the pilot head is deflected from a desired direction of propulsion, the pilot head and the pilot pipes can be pulled back a certain distance, whereupon the direction of propulsion of pilot head can be corrected according to the foregoing process and then the pilot head and the pilot pipes can be propelled again. The pilot head 1 and the pilot pipes 2 are bolted, but one more bolt-connections as shown in FIG. 4 are made by means of the loose-couplings as shown in FIG. 5 which are different then tight-couplings at the other bolt-connections, so that the pilot head can maintain the ability of its direction control and at the same time can be withdrawn. The pilot pipes 2 which are tightly coupled and follow the loosely coupled pipes are propelled in the ground as a straight, rod-like member. This is advantageous in that it corrects and reduces meandering movement of the pilot head during its direction control operation, and is useful especially where drainage conduits are laid in when meandering disposition of the conduits is prohibited strictly.

Figure 7:
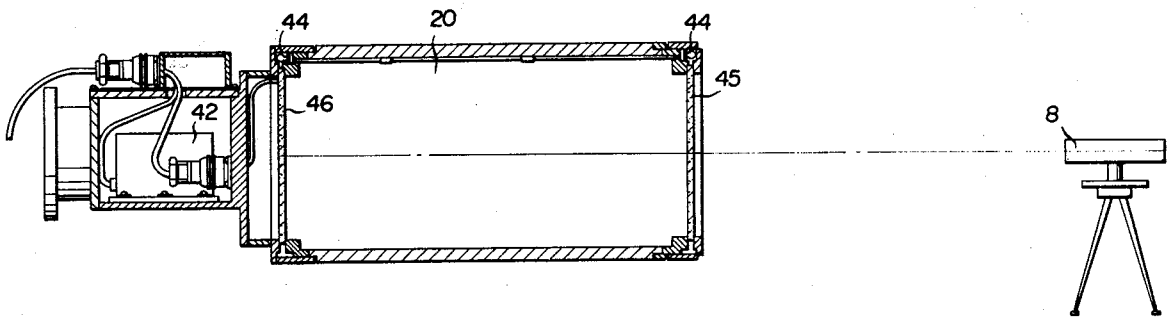
FIG. 7 is a schematic view showing the manner in which the position and posture of the pilot head are observed.

FIG. 7 is a schematic view showing in detail the target 20 and clinometer 42 for detecting the direction of the pilot head. The target 20 comprises a pair of indicia plates 45, 46 each made of a transparent plate such as a sheet of glass having indicia inscribed thereon, and a pair of lamps 44 for illuminating the indicia, the indicia plates being arranged perpendicularly to the axis of propulsion of the pilot head and being built in the casing of the pilot head. The center of the two indicia plates 45, 46 is positioned on the axis of propulsion of the pilot head. When the lamp 44 for the indicia plate 45 is turned off and at the same time the lamp 44 for the indicia plate 46 is turned on, the transit 8 set in registry with the datum line of propulsion within the departure pit can readily observe the indicia plate 46 since the indicia plate 45 is transparent. When it is necessary to observe the indicia plate 45, the lamp 44 for the indicia plate 46 is turned off and the lamp 44 for the indicia plate 45 is turned on. The displacement of the indicia plates 45, 46 from the datum line of propulsion is observed by the transit 8, according to which a tilt of the pilot head can easily be known by the calculation of trigonometric function. With the arrangement shown in FIG. 7, the position and tilt of the pilot head can be measured by the transit and, furthermore, a tilt of the pilot head in the vertical direction is electrically detected by the clinometer 42, the detected signal therefrom being transmitted through the electric cable to an indicator (not shown) in the departure pit, at which indicator the signal can be read out. With the use of the clinometer 42, there are no reading errors by the observation of the transit 8 and high-precision measurement is possible. The clinometer 42 is suitable particularly for drainage construction where high pipe laying-in precistion is required in the direction of plane normal to the axis of the laid-in pipes. As another example of the target, there may be used an arrangement of the type having a convex lens at the leftwardly of the indicia plate 45 of FIG. 7 and a light spot position detector (not shown) in lieu of the indicia plate 46. The signal from the light spot position detector is amplified by an amplifier and can be read out at the indicator in the departure pit. By using a transit with a laser as the transit, the position of the indicia plate and the signal from the light spot position detector generated by the emission of a leaser beam can simultaneously be read out. This arrangement makes it possible to measure a tilt angle of the pilot head with high precision where the pilot head is propelled in the ground a long distance.

Figure 8:
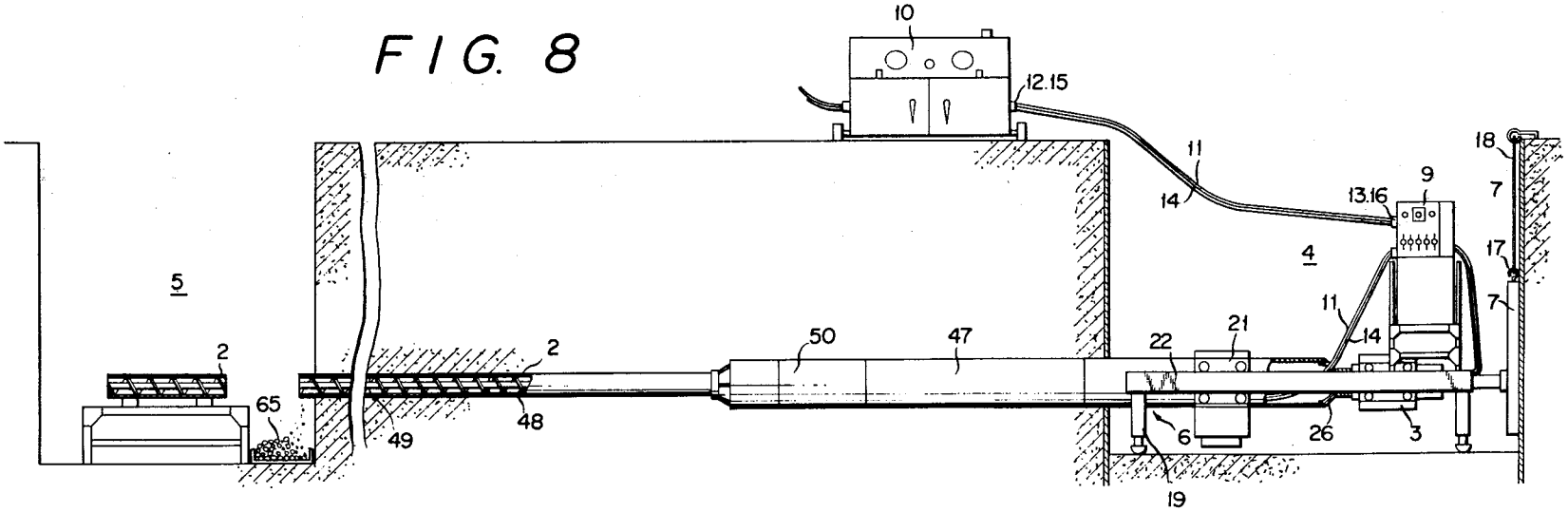
FIG. 8 is a schematic elevational view explanatory of the way in which large-diameter pipes are laid into the ground by the use of the pilot pipes as a guidance.
Figure 9:
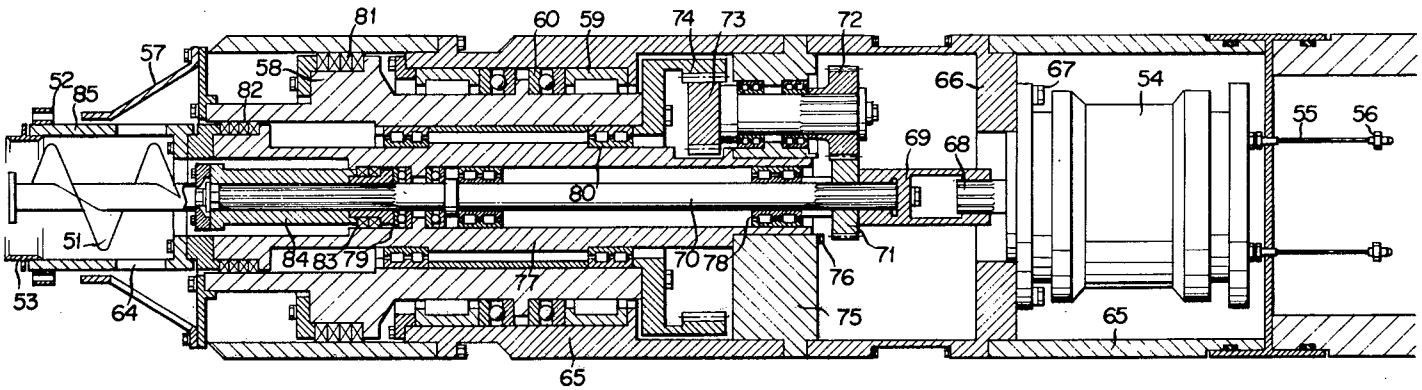
FIG. 9 is a longitudinal cross-sectional view of an excavator.

Referring now to FIG. 8, a process of laying in pipes 47 having a diameter larger than the previously laid-in pilot pipes, the large-diameter pipes being led by the pilot pipes. As shown in FIG. 8, a plurality of screw conveyors 48 are inserted in the inlaid pilot pipes 2, the screw conveyors extending the entire length of the inlaid pilot pipes and being interconnected just at the locations where the pilot pipes are interconnected at 49. The pipe-supporting rollers 35 of the pipe support 21 are adjusted in height in order to align the central axis of the pipes 47 to be laid in with that of the propulsion jack 3. The adapter 26 for the pilot pipes is replaced with an adapter having parts suitable for the diameter of the large-diameter pipes 47, and the transit 8 is removed from the departure pit. An excavator 50 is placed on the pipe support 21 and, then, a screw conveyor 51 disposed within the excavator is coupled to the connected screw conveyors 48 within the pilot pipes (see FIG. 9). Bosses 52 on a front end guide portion of the excavator 50 are bolted to the bosses 37 on the inlaid pilot pipe 2. As shown in FIG. 9, a collar 53 is placed within the coupled pilot pipe and front end guide portion of the excavator. Piping 55 to a hydraulic motor 54 housed in a rear portion of the excavator is connected via a connector 56 with the hydraulic hose 11 leading from the control unit 9. The hydraulic hose 11 passes through the cutaway recess 27 in the adapter 26. The preparation for laying in the large-diameter pipes 47 is completed, and the laying-in of the pipes will now be initiated.

Figure 10:
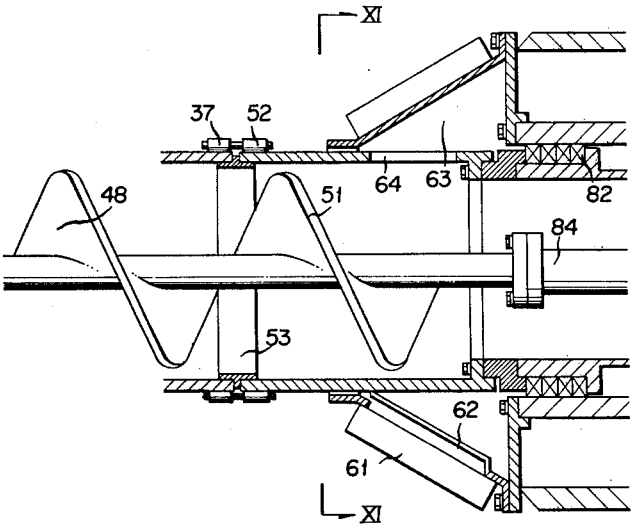
FIG. 10 is a cross-sectional view, on an enlarged scale, showing the front parts of the excavator.
Figure 11:
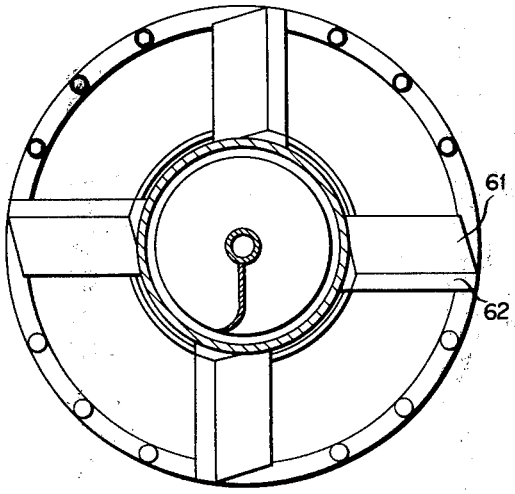
FIG. 11 is a cross-sectional view taken along line1-1—11 of FIG. 10.

Fluid of an amount sufficiently enough to drive the hydraulic motor 54 is supplied by a flow adjustment device (not shown) disposed within the hydraulic unit 10 to the oil pressure supplying rubber hose 11, so that the screw conveyors 48 are driven to rotate by the hydraulic motor 54 and, simultaneously, a rotary bucket 57 of the excavator 50 is driven to rotate. Alternatively, two hydraulic motors may be used to drive the screw conveyors 48 and the rotary bucket 57, separately. However, the screw conveyors 48 and the rotary bucket 57 can be rotated by one hydraulic motor through a suitable gear train. Normally, it is preferable to rotate the screw conveyors 48 and the rotary bucket 57 in different rates of revolution and in opposite directions. With this design, the number of revolutions of and the direction of rotation of the screw conveyors 48 and the rotary bucket 57 can be changed independently thereby accomplishing the excavation and discharge of earth at maximum efficiency. The rotary bucket 57 is bolted to a drum 58 which in turn is rotatably mounted within the excavator proper via a radial roller bearing 59 and a thrust roller bearing 60. The rotary bracket 57 is provided at it tapered front end with a plurality of cutter blades 61 which serve to excavate earth and a plurality of openings 62 adjacent the cutter blades 61 (see FIGS. 10 and 11). By restricting the size of the openings 62, stones of a predetermined size can be prevented from entering into the excavator and, instead, is pushed away by the tapered portion of the rotary bucket into the soil around the inlaid pipes. The earth scraped by the cutter blades 61 is admitted into a space 63 through the openings 62 and delivered to the screw conveyor 51 through cutaway recesses 64. Then, the earth is transferred by the screw conveyors 48 within the pilot pipes and discharged in the arrival pit 5. In order to allow earth to enter the cutaway recesses 64 smoothly in the case of some kinds of soil, the cutaway recesses may be increased in size and number, or otherwise, water may be forcibly ejected from the shaft of the screw conveyor to facilitate the separation of earth. During this operation, the propulsion jack 3 is operated to press the excavator into the ground as the means for excavating and hauling the earth are driven to be advanced. At this time, when a load on the rotary bucket 57 becomes increased excessively, the pilot pipes 2 can be pushed back from the arrival pit 5 so as to reduce the resistance of soil. Alternatively, a cutter jack may be internally housed to provide a multi-step propulsion function to this end. After the excavator 50 is laid into the ground by a predetermined distance, the connector 56 for the hydraulic piping 55 is detached whereupn the propulsion jack 3 is returned. A first pipe 47 to be laid in is placed on the pipe support 21 and, then, the hydraulic piping 11 is passed through the pipe 47, whereupon the connector 56 is connected. Again, the hydraulic motor 54 and the propulsion jack 3 are driven so as to lay the first pipe 47 in the ground. This operation is repeated with respect to second, third . . . and n-th pipes with hydraulic piping being detached, re-connected and added where necessary. The scraped earth is then discharged to the arrival pit, and the pilot pipes 2 as well as the screw conveyors 48 are likewise forced out into the arrival pit 5. When the excavator 50 proper is all forced out into the arrival pit 5, the operation of laying-in of the pipes is finished. In FIG. 8, the hydraulic hose 11 is removed from the pipes as in the case where the pilot pipes 2 are laid in. In the foregoing embodiment, the hydraulic motor 54 is employed to operate the screw conveyors 48 and the rotary bucket 57, but an electric motor may be used instead of the hydraulic motor, where an electric cable must be used in lieu of the hydraulic piping. Since the length of the screw conveyor 48 is the same as the stroke of the propulsion jack 3, it is practically desirable to use a screw conveyor having the same length as a pipot pipe 2.

The structural details of the excavator will now be given.

FIG. 9 shows the excavator 50 as seen in FIG. 8, which excavator compriese a casing 65 and a hydraulic motor or an electric motor 54 (with a reducer) housed within the casing 65, the motor being fixed to a guiding member 66 by bolts 67. The hydraulic piping (rubber hose or the like) or an electric power connection member (an electric cable or the like) 55 is provided at one end with the hydraulic or electric plug 56 to facilitate connection and disconnection of the member 55. The plug 56 is connected to a plug at one end of the hydraulic piping 11 or the electric power connection member 14, a plug at the other end of the member 11 or 14 being connected to the control unit 9 so as to supply the hydraulic or electric motor 54 with power. A motor-driven shaft 68 is coupled by a spline, a key or the like to a screw conveyor driving shaft 70 through a coupling 69 so as to drive the shaft 70. The screw conveyor driving shaft 70 has one end splined with which end there is engaged a gear 71 which is adapted to rotate a shaft 74 having a pair of gears 72, 73 at both ends. The gear 73 meshes with and is adapted to rotate a gear 74 having internal teeth which gear 74 is bolted to the drum 58. The drum 58 is supported on and is adapted to revolve in the casing via the radial roller bearing 59 and the thrust roller bearing 60 (or a taper-rolling bearing). The rotary bucket 57 is bolted to the drum 58 proper and can be replaced when necessary to meet a particular diameter of pipes to be laid in. The screw conveyor driving shaft 70 is disposed within and coaxial with the casing 65. The shaft 70 is supported by a radial roller bearing 78 and a thrust roller bearing 78 in the bearing sleeve 77 which is coupled with a retainer 75 by a bolt 76, the retainer 75 being bolted to the casing 65. There is provided between the bearing sleeve 77 and the drum 58, whereby the drum 58 can rotate relative to the non-rotatable bearing sleeve 77. There are inserted packings 81, 82 and 83, between a front end portion of the casing 65 and the drum 58, between the drum 58 and the bearing sleeve 77, and between the screw conveyor driving shaft 70 and the bearing sleeve 77, respectively, to prevent the entrance of earth. The screw conveyor driving shaft is also provided at its front end with a spline to which is coupled a screw conveyor driving sleeve 84 which in turn is bolted to the screw conveyor driving shaft 70 to prevent the axial displacement thereof. The screw conveyor driving sleeve 84 has at one end a flange which is connected to a flange of the screw conveyor 51 thereby enabling the screw conveyor to be rotated. The bearing sleeve 77 has at its front end a pipe 85 bolted thereto, the pipe 85 being of the same outside diameter as the pilot pipes 2. The pipe 85 has its front end projecting beyond the front end of the rotary bucket 57 and is provided with the cutaway recesses 64. The front end of the pipe 85 is provided with the bosses 52 for bolt-connection with the pilot pipe, the pipe 85 and the pilot pipe 2 being interconnected by these bosses. The collar 53 is positioned between the pipe 85 and the pilot pipe 2. Rotating the pilot pipes requires a large amount of force on account of the bolted pilot pipes having outside peripheral surfaces subjected to consolidation of soil therearound. Thus, torques of the screw conveyors 48 and the rotary bucket 57 can all be absorbed by the pilot pipes. Naturally, it is desirable to maintain the torques as small as possible, the directions of rotation of the screw conveyors 48 and the rotary bucket 57 are opposite to each other in an attempt to counteract these torques.

As is apparent from the foregoing description, during the operation of laying-in of pipes in accordance with the present invention, small-diameter pilot pipes are first laid in accurately as a degree of straight advance of a pilot head is measured and controlled, and then large-diameter pipes are led by the inlaid pilot pipes and laid in the ground. Advantageously, the process of the invention makes it possible to lay drainage water, gas pipes or the like in the ground with high precision and efficiency.

What is claimed is:

1. A method of laying pipes in the ground comprising:

a. digging a departure pit and an arrival pit which is spaced apart from the departure pit;

b. providing a propulsion jack in said departure pit, said propulsion jack being adapted to propel the pipes to be laid in;

c. pressing a pilot head into the ground by the pressure from said propulsion jack;

d. pressing pilot pipes successively into the ground by said propulsion jack, said pilot pipes being laid in following relation to said pilot head;

e. measuring the position and posture of said pilot head laid in the ground from within said departure pit, while the pilot head is being laid in;

f. controlling said pilot head to make a straight advance based on said measurement, thereby laying the pipes in the ground between the departure pit and the arrival pit;

g. providing hauling means in said pilot pipes for conveying earth to the arrival pit, said earth being scraped;

h. connecting an excavator to said hauling means, said excavator being adapted to excavate earth in following relation to said pilot pipes;

i. pressing said pilot pipes said hauling means and said excavator by said propulsion jack disposed in the departure pit while said hauling means and the scraping means of said excavator are driven to rotate;

j. scraping off the earth located forward of the excavator by the scraping means of the latter;

k. pressing laid-in pipes by said propulsion jack in following relation to said excavator as the latter scrapes off the earth;

l. discharging the scraped earth into said arrival pit through said pilot pipes by said hauling means; and m. collecting successively at said arrival pit said laid-in pilot pipes and said hauling means disposed in the laid-in pilot pipes.

2. A method as defined in claim 1, further comprising collecting said excavator at the arrival pit.

3. A method as defined in claim 1, further comprising pressing said laid-in pilot pipes from the arrival pit so as to retract said excavator toward the departure pit thereby reducing excessive resistance acting against the scraping means of the excavator.

4. A method of laying pipes in the ground comprising:

a. digging a departure pit and an arrival pit which is spaced apart from the departure pit;

b. providing a propulsion jack in said departure pit, said propulsion jack being adapted to propel the pipes to be laid in;

c. pressing a pilot head into the ground by the pressure from said propulsion jack;

d. pressing pilot pipes successively into the ground by said propulsion jack, said pilot pipes being laid in following relation to said pilot head;

e. measuring the position and posture of said pilot head laid in the ground from within said departure pit, while the pilot head is being laid in;

f. controlling said pilot head to make a straight advance based on said measurement, thereby laying the pipes in the ground between the departure pit and the arrival pit; and g. wherein a pilot jack is provided on the front portion of said pilot head and wherein said pilot head is laid in through multi-step propulsion in which said pilot head is advanced by the alternate advance of said propulsion jack and said pilot jack.

5. A method as defined in claim 4, further comprising:

pulling back a slight distance said pilot head and said laid-in pilot pipes toward the departure pit; and laying in pipes again during which time the straight advance of the pilot head is measured and controlled from within the departure pit.

6. An apparatus for laying in pipes comprising:

a. a base disposed within a departure pit and having a pair of parallel rails extending in a direction in which the pipes are laid in;

b. a pipe support on said rails on the base and supporting the pipes to be laid in;

c. a propulsion jack on said rails on the base and adapted to press the pipes into the ground, said propulsion jack being movable in said direction on the rails;

d. engaging means for engaging said propulsion jack with said rails on the base;

e. a pilot head adapted to be propelled by said propulsion jack and press earth in said direction;

f. pipes adapted to be laid into the ground and propelled by said propulsion jack, said pipes being connected with said pilot head which has been laid in;

g. coupling means for coupling said pilot head with said laid-in pipes;

h. a target disposed within said pilot head and serving as a standard indicative of a degree the straight advance of the pilot head;

i. measuring means disposed within the departure pit for measuring said target in order to determine a degree of the straight advance of the pilot head; and j. controlling means for controlling the straight advance of the pilot head based on measured values obtained by said measuring means.

7. An apparatus as defined in claim 6, wherein said pipe and said propulsion jack are interconnected by an adapter having a partial cutaway recess.

8. An apparatus as defined in claim 6, wherein said engaging means is a pin and said coupling means is a loose coupling formed by a bolt and a nut.

9. An apparatus as defined in claim 8, further comprising first coupling means for loosely coupling two or three laid-in pipes together positioned in immediately following relation with said pilot head, and second coupling means for tightly coupling the remaining pipes together.

10. An apparatus as defined in claim 6, wherein said measuring means is a transit, and said controlling means includes a control unit connected to said pilot head and a hydraulic unit connected to said control unit.

11. An apparatus as defined in claim 6, wherein said pilot head includes a clinometer for detecting the posture thereof and a pilot jack at its front end for pressing earth.

* * * * *